US006469451B2

(12) United States Patent
Mori

(10) Patent No.: US 6,469,451 B2
(45) Date of Patent: Oct. 22, 2002

(54) ALTERNATING-CURRENT-DRIVEN-TYPE PLASMA DISPLAY

(75) Inventor: Hiroshi Mori, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/814,059

(22) Filed: Mar. 22, 2001

(65) Prior Publication Data

US 2002/0047583 A1 Apr. 25, 2002

(30) Foreign Application Priority Data

Mar. 28, 2000 (JP) ..... 2000-089439

(51) Int. Cl.[7] ..... G09G 3/10

(52) U.S. Cl. ..... 315/169.4; 345/55; 345/60; 313/590; 313/582

(58) Field of Search ..... 315/169.4, 169.1; 345/55, 60, 67, 37, 84; 313/590, 582, 584–587

(56) References Cited

U.S. PATENT DOCUMENTS 5,952,783 A * 9/1999 Kuroki et al. ..... 313/582
5,952,986 A * 9/1999 Nguyen et al. ..... 345/209
6,169,363 B1 * 1/2001 Mori et al. ..... 313/582
6,295,040 B1 * 9/2001 Nhan et al. ..... 345/60

* cited by examiner

*Primary Examiner*—Haissa Philogene
(74) *Attorney, Agent, or Firm*—Rader, Fishman & Grauer PLLC; Ronald P. Kananen, Esq.

(57) ABSTRACT

An alternating current-driven-type-plasma display having a first panel and a second panel, said first panel comprising (A) a first substrate, (B) a first sustain electrode formed on the first substrate, (C) a first separation wall that is formed on the first substrate and extends in a first direction, and (D) a second sustain electrode formed on an upper portion of a side wall on one side of the first separation wall and spaced from the first sustain electrode, and said second panel comprising (a) a second substrate, (b) a second separation wall which is formed on the second substrate and extends in a second direction different from the first direction in which the first separation wall extends, (c) an address electrode formed on the second substrate, and (d) a phosphor layer formed on or above the address electrode.

7 Claims, 15 Drawing Sheets

(EXAMPLE 1)

[STEP-100]

[STEP-120]

[STEP-130]

[STEP-130] CONTINUED (EXAMPLE 2)

(EXAMPLE 3)

(EXAMPLE 4)

(EXAMPLE 5)

ALTERNATING-CURRENT-DRIVEN-TYPE PLASMA DISPLAY

BACKGROUND OF THE INVENTION AND RELATED ART STATEMENT

The present invention relates to a so-called three-electrode-type alternating-current-driven-type plasma display having pairs of sustain electrodes and address electrodes.

As an image display device that can be substituted for a current mainstream cathode ray tube (CRT), flat-screen (flat-panel) displays are studied in various ways. Such flat-panel displays include a liquid crystal display (LCD), an electroluminescence display (ELD) and a plasma display (PDP). Of these, the plasma display has advantages such as a relative easiness to form a larger screen and attain a wider viewing angle, excellent durability against environmental factors such as temperatures, magnetism, vibrations, etc., and a long lifetime. It is therefore expected that the plasma display can be applied not only to a home-use wall-hung television set but also to a public large-sized information terminal.

In the plasma display, a voltage is applied to discharge cells charged with a discharge gas, such as a rare gas, and a phosphor layer in the discharge cell is excited with an ultraviolet ray generated by glow discharge in the discharge gas to emit light. That is, each discharge cell is driven according to a principle similar to that of a fluorescent lamp, and generally, the discharge cells are put together on the order of hundreds of thousands to constitute a display screen. The plasma display is largely classified into a direct-current driven type (DC type) and an alternate-current driven type (AC type) according to the methods of applying a voltage to the discharge cells, and each type has advantages and disadvantages. AC-type plasma displays are commercially produced and constitute a mainstream in the market.

FIG. 15 shows a typical constitution of a conventional AC-type plasma display. This AC-type plasma display comes under a so-called three-electrode type, and discharge is caused by a pair of sustain electrodes 112 and an address electrode 122. In the AC type plasma display shown in FIG. 15, a first panel 110 corresponding to a front panel and a second panel 120 corresponding to a rear panel are bonded to each other in their circumferential portions. Light emission from a phosphor layer 125 on the second panel 120 is viewed, for example, through the first panel 110.

The first panel 110 comprises a transparent first substrate 111, sustain electrodes 112 made of a transparent electrically conductive material and formed in the form of a stripe on the first substrate 111, bus electrodes 116 made of a material having a lower electric resistivity than the sustain electrodes 112 and provided for decreasing the impedance of the sustain electrodes 112, and a protective layer 117 made of a dielectric material and formed on the first substrate 111, the bus electrodes 116 and the sustain electrodes 112. The protective layer 117 is constituted of two layers such as a dielectric material layer and a covering layer that are positioned in this order from the first substrate side, while it is shown as a single layer.

The second panel 120 comprises a second substrate 121, address electrodes (also called "data electrodes") 122 formed in the form of a stripe on the second substrate 121, a dielectric material film 123 formed on the second substrate 121 and the address electrodes 122, insulating separation walls 124 which are formed in regions on the dielectric material film 123 between neighboring address electrodes 122 and extend in parallel with the address electrodes 122, and phosphor layers 125 each of which is formed on the dielectric material film 123 and on side walls of the separation wall 124. The phosphor layers 125 are composed of a red phosphor layer 125R, a green phosphor layer 125G and a blue phosphor layer 125B, and these phosphor layers 125R, 125G and 125B for corresponding colors are arranged in a predetermined order. FIG. 15 shows a partial exploded perspective view, and an actual embodiment; and, top portions of the separation walls 124 on the second panel side are in contact with the protective layer 117 on the first panel side. A region where a pair of the sustain electrodes 112 and the address electrode 122 positioned between the two neighboring separation walls 124 overlap corresponds to one discharge cell. And, a rare gas is sealed in each space surrounded by the neighboring separation walls 124, the phosphor layer 125 and the protective layer 117.

The extending direction of projection image of the sustain electrode 112 and the extending direction of projection image of the address electrode 122 cross each other at right angles, and a region where a pair of the sustain electrodes 112 and one set of the phosphor layers 125R, 125G and 125B overlap corresponds to one pixel. Since glow discharge takes place between a pair of the sustain electrodes 112, a plasma display of the above type is called a "surface discharge type". A pulse voltage lower than the discharge start voltage of the discharge cell is applied to the address electrode 122 immediately before the application of a voltage to a pair of the sustain electrodes 112, whereby a wall charge is accumulated in the discharge cell (selection of a discharge cell for display), so that the apparent discharge start voltage decreases. Then, discharge that starts between a pair of the sustain electrodes 112 can be sustained at a voltage lower than the discharge start voltage. In the discharge cell, the phosphor layer excited by irradiation with vacuum ultraviolet ray generated by glow discharge in the rare gas emits light in a color inherent to the phosphor material. The vacuum ultraviolet ray that is generated has a wavelength dependent upon the sealed rare gas.

The light emission state of glow discharge in the discharge cell will be explained below with reference to FIGS. 13A, 13B, 14A and 14B. FIG. 13A schematically shows a light emission state when DC glow discharge is carried out in a discharge tube with a rare gas sealed therein. From the cathode to the anode, an Aston dark space A, a cathode glow B, a cathode dark space (Crookes dark space) C, a negative glow D, a Faraday dark space E, a positive column F and an anode glow G consecutively appear. In AC-glow discharge, a cathode and an anode are repeatedly altered at a predetermined frequency, so that the positive column F is positioned in a central area between the electrodes and the Faraday dark spaces E, the negative glow D, the cathode dark spaces C, the cathode glow B and the Aston dark spaces A consecutively appear symmetrically on both sides of the positive column F. The state shown in FIG. 13B is observed when the distance between the electrodes is sufficiently large like a fluorescent lamp. As the distance between the electrodes is decreased, the length of the positive column F decreases. When the distance between the electrodes is further decreased, the positive column F disappears, the negative glow D is positioned in the central area between the electrodes, and the cathode dark spaces C, the cathode glow B and the Aston dark spaces A appear symmetrically on both sides in this order as shown in FIG. 14A. The state shown in FIG. 14A is observed when the distance between the electrodes is a state that can be attained in a conventional general AC-type plasma display.

Meanwhile, in the conventional AC-type plasma display shown in FIG. 15, pairs of the sustain electrodes 112 are formed on one plane. The distance between one sustain electrode 112 and the other sustain electrode 112 of each pair is therefore required to be a predetermined gap (d), for example, for causing the negative glow discharge. The above gap (d) is defined by Paschen's law that a discharge start voltage $V_{bd}$ can be expressed by the function of the product d-p of the gap (d) and the gas pressure (p), and it is generally at least 100 $\mu$m in the negative glow discharge. Further, the sustain electrodes 112 are required to be tens of microns or more for decreasing the impedance thereof.

When the distance from one discharge cell to another neighboring discharge cell is 200 $\mu$m, when each sustain electrode 112 has a width of 60 $\mu$m and when the gap (d) of the sustain electrodes is at least 70 $\mu$m, the discharge cell pitch comes to be 390 82 m or more. In such a structure, the largest distance between one sustain electrode 112 and another neighboring sustain electrode 112 comes to be 190 $\mu$m, which is a distance sufficient for causing a negative glow discharge. Further, in an AC-type plasma display having the conventional structure, it is difficult to produce an AC-type plasma display in which the pixel pitch is smaller than 390 $\mu$m when attainable brightness is taken into account.

OBJECT AND SUMMARY OF THE INVENTION

It is therefore an object of the present invention to provide an alternating-current-driven-type plasma display which makes it possible to decrease the size of each pixel, i.e., the size of each discharge cell.

According to the present invention, the above object of the present invention is achieved by an alternating-current-driven-type plasma display (to be simply referred to as "plasma display" hereinafter) having a first panel and a second panel, said first panel comprising, (A) a first substrate, (B) a first sustain electrode formed on the first substrate, (C) a first separation wall that is formed on the first substrate and extends in a first direction, and (D) a second sustain electrode formed on an upper portion of a side wall on one side of the first separation wall and spaced from the first sustain electrode, and said second panel comprising, (a) a second substrate, (b) a second separation wall that is formed on the second substrate and extends in a second direction different from the first direction in which the first separation wall extends, (c) an address electrode formed on the second substrate, and (d) a phosphor layer formed on or above the address electrode.

The plasma display of the present invention is a so-called three-electrode-type plasma display. In the plasma display of the present invention, the first panel and the second panel are arranged so as to face each other such that pairs of the sustain electrodes (the first sustain electrode and the second sustain electrode) and the address electrode face each other. For structural simplification of the plasma display, preferably, the first direction and the second direction make an angle of 90 degrees.

A discharge cell is constituted of a pair of the first separation walls formed on the first substrate, a pair of the second separation walls, and the first and second sustain electrodes, the address electrode and the phosphor layer which occupy a region surrounded by the above first and second separation walls.

The plasma display of the present invention may have a constitution in which the address electrode extends in the second direction. In this constitution, the first sustain electrode may extend in the second direction. The plasma display having the above constitution will be referred to as the "plasma display having the first constitution of the present invention" for convenience. The first separation wall is formed across the first sustain electrode. Alternatively, there may be employed a constitution in which the first sustain electrode extends in the first direction. The plasma display having such a constitution will be referred to as the "plasma display having the second constitution of the present invention" for convenience. In the plasma display having the first or second constitution of the present invention, the first panel may further have a third separation wall that is formed on the first substrate and extends in the second direction. That is, the first and third separation walls are formed on the first substrate in the form of a lattice. In the plasma display having the first constitution of the present invention, the third separation wall is formed across the second sustain electrode. In the plasma display having the second constitution of the present invention, the third separation wall is formed across the first and second sustain electrodes.

Alternatively, the plasma display of the present invention may have a constitution in which the first panel further has a third separation wall that is formed on the first substrate and extends in the second direction, the first sustain electrode extends in the second direction, and the address electrode extends in the first direction. The plasma display having the above constitution will be referred to as the "plasma display having the third constitution of the present invention" for convenience. In the plasma display having the third constitution of the present invention, the first and the third separation walls are formed on the first substrate in the form of a lattice. In this case, the third separation wall is formed across the second sustain electrode, and the second separation wall is formed across the address electrode.

In the plasma display having the first or second constitution of the present invention, the second sustain electrode extends in the first direction, and the address electrode extends in the second direction. Therefore, when a voltage is applied to the second sustain electrode and the address electrode, a discharge cell having an overlap of the second sustain electrode and the address electrode is selected as a discharge cell to discharge. In the plasma display having the third constitution of the present invention, both the second sustain electrode and the address electrode extend in the first direction. Therefore, when a voltage is applied to the second sustain electrode and the address electrode, discharge cells on an entire one line are selected as discharge cells to discharge, and as a result, an optical crosstalk is liable to take place between the neighboring discharge cells. The above crosstalk can be reliably prevented when the third separation wall extending in the second direction is formed on the first substrate.

In the plasma display of the present invention, preferably, the distance ($L_1$) between the first sustain electrode and the address electrode is $1\times10^{-5}$ m to $4\times10^{-4}$ m, desirably $5\times10^{-5}$ m to $2\times10^{-4}$ m, and the distance ($L_2$) between the second sustain electrode and the address electrode is $5\times10^{-6}$ m to $3\times10^{-4}$ m, desirably $2\times10^{-5}$ m to $1.5\times10^{-4}$ m. When the distance ($L_1$) between the first sustain electrode and the address electrode is set to be $1\times10^{-5}$ m to $4\times10^{-4}$ m, a sufficient space (which will be called "discharge space") surrounded by a pair of the first separation walls formed on the first substrate and a pair of the second separation walls formed on the second substrate can be secured. Further, when the distance ($L_2$) between the second sustain electrode and the address electrode is set to be $5\times10^{-6}$ m to $3\times10^{-4}$ m, a sufficient thickness can be secured for the phosphor layer.

Preferably, the distance ($L_0$) between the first sustain electrode and the second sustain electrode is $5\times10^{-6}$ m to $3\times10^{-5}$ m, desirably, $1\times10^{-5}$ m to $2\times10^{-5}$ m. When the distance ($L_0$) between the first sustain electrode and the second sustain electrode is $5\times10^{-6}$ m to $3\times10^{-5}$ m, cathode glow discharge comes to be predominant as glow discharge.

The space (discharge space) surrounded by a pair of the first separation walls formed on the first substrate and a pair of the second separation walls formed on the second substrate is charged with a rare gas and sealed, and the phosphor layer emits light on irradiation with a vacuum ultraviolet ray generated by AC-glow discharge that takes place between the first and second sustain electrodes in the rare gas.

In the plasma display of the present invention, desirably, the pressure of the rare gas sealed in the discharge space is $1\times10^2$ Pa to $5\times10^5$ Pa, preferably $1\times10^3$ Pa to $4\times10^5$ Pa. When the distance ($L_0$) between the first sustain electrode and the second sustain electrode (to be sometimes referred to as "a pair of the sustain electrodes" hereinafter) is less than $5\times10^{-5}$ m, desirably, the pressure of the rare gas in the discharge space is not less than $1\times10^2$ Pa but not more than $3\times10^5$ Pa, preferably not less than $1\times10^3$ Pa but not more than $2\times10^5$ Pa, and more preferably not less than $1\times10^4$ Pa but not more than $1\times10^5$ Pa. When the pressure of the rate gas is in the above range, the phosphor layer emits light upon irradiation with vacuum ultraviolet ray generated mainly by the cathode glow in the rare gas, and in the above pressure range, the sputtering ratio of each member constituting the plasma display decreases with an increase in the pressure, so that a longer lifetime for the plasma display can be attained.

FIG. 14B schematically shows a light emission state in the plasma display of the present invention when an AC voltage is applied to a pair of the sustain electrodes and when the distance ($L_0$) between a pair of the sustain electrodes is less than $5\times10^{-5}$ m. The cathode glow B is positioned in the central portion between a pair of the sustain electrodes, and the Aston dark space A appears on each side of the cathode glow B. In some cases, the negative glow can be present partially. When the distance ($L_0$) between a pair of the sustain electrodes is set to be less than $5\times10^{-5}$ m in the plasma display of the present invention as described above, a discharge mode (cathode glow) entirely different from that in a conventional plasma display can be utilized. Therefore, high AC-glow discharge efficiency can be attained, so that the plasma display can perform with high light-emission efficiency and high brightness. In the plasma display of the present invention, the discharge state shown in FIG. 14A can be also attained by properly setting the distance ($L_0$) between the first sustain electrode and the second sustain electrode (a pair of the sustain electrodes).

The electrically conductive material for constituting the first sustain electrode differs depending upon whether the plasma display is a transmissiton-type or a reflection-type. In the transmission-type plasma display, light emission from the phosphor layer is observed through the second substrate, so that it is not a problem if the electrically conductive material for constituting the first sustain electrode is transparent or non-transparent. However, the address electrode is formed on the second substrate, so that the address electrode is required to be transparent. In the reflection-type plasma display, light emission from the phosphor layer is observed trough the first substrate, so that it is not a problem whether a electrically conductive material for constituting the address electrode is transparent or non-transparent. However, the electrically conductive material for constituting the first sustain electrode is required to be transparent. The term "transparent" or "non-transparent" are based on the transmissivity of the electrically conductive material to light at the wavelength of emitted light (in visible light region) inhererent to the phosphor materials. That is, when an electrically conductive material for constituting the first sustain electrode or for the address electrode is transparent to light emitted from the phosphor layer, such an electrically conductive material can be said to be transparent. Since the second sustain electrode is formed on the upper portion of the side wall on one side of the first separation wall, it is not a problem if the electrically conductive material for constituting the second sustain electrode is transparent or non-transparent. Preferably, the second sustain electrode is made of a material having a low electric resistivity for decreasing the impedance of the second sustain electrode. Non-transparent electrically conductive materials includes Ni, Al, Au, Ag, Pd/Ag, Cr, Ta, Cu, Ba, $LaB_6$, $Ca_{0.2}La_{0.8}CrO_3$, etc., and these materials may be used alone or in combination. Transparent electrically conductive materials includes ITO (indiumtin oxide) and $SnO_2$.

In addition to the first sustain electrode, a bus electrode made of a material having a lower electric resistivity than the first sustain electrode may be formed, on the first substrate, in contact with the first sustain electrode for decreasing the impedance of the first sustain electrode as a whole. The bus electrode can be constituted, typically, of a metal material such as Ag, Al, Ni, Cu, Cr or a Cr/Cu/Cr stacked film. In the reflection-type plasma display, the bus electrode made of the above metal material can be a factor in decreasing the transmission quantity of visible light the is emitted from the phosphor layer and passes through the first substrate, so that the brightness of a display screen is decreased. It is therefore preferred to form the bus electrode to be as narrow as possible as long as the electric resistance value necessary for the first sustain electrode can be obtained.

Preferably, a protective layer is formed on the surface of the first sustain electrode (and also on the surface of the second sustain electrode in some cases). The protective layer can prevent direct contact of ions or electrons with the sustain electrodes, and as a result, the wearing of the sustain electrodes can be prevented. The protective layer works to accumulate a wall charge generated during an address period, works to emit secondary electrons necessary for discharge, works as a resistance to limit an excess discharge current and works as a memory to sustain a discharge state. The material for the protective layer includes magnesium oxide (MgO), magnesium fluoride ($MgF_2$) and aluminum oxide ($Al_2O_3$). Of these, magnesium oxide is a suitable material that has chemical stability, shows a low sputtering rate, has high transmissivity in the wavelength of light emitted from the phosphor layer and has a low discharge start voltage. The protective layer may have a stacked structure made of at least two material selected from magnesium oxide, magnesium fluoride and aluminum oxide.

Otherwise, the protective layer may have a two-layered structure. The protective layer having a two-layered structure can be constituted of a dielectric material layer that is in contact with the sustain electrodes, and a covering layer that is formed on the dielectric material layer and has higher secondary electron emission efficiency than the dielectric material layer. Typically, the dielectric material layer is made of a low-melting glass or $SiO_2$. Typically, the covering layer can be made of magnesium oxide (MgO), magnesium fluoride ($MgF_2$) or aluminum oxide ($Al_2O_3$). The above two-layered structure can be employed for securing the tranparency of the protective layer as a whole with the dielectric material layer and securing a high secondary electron emission efficiency with the covering layer when the transparency (light transmissivity) of the covering layer in the wavelength region of a vacuum ultraviolet ray is not so high. In the above manner, a stable discharge sustain operation can be attained, and a vacuum ultraviolet ray comes to be absorbed into the protective layer to a less a degree. Further, there can be obtained a structure in which visible light emitted from the phosphor layer is absorbed into the protective layer to a less degree.

Examples of the material for constituting the first substrate and the second substrate include soda glass ($Na_2O.CaO.SiO_2$), borosilicate glass ($Na_2O.B_2O_3.SiO_2$), forsterite ($2MgO.SiO_2$) and lead glass ($Na_2O.PbO.SiO_2$). The material for the first substrate and the material for the second substrate may be the same as, or different from, each other.

The phosphor layer is made of phosphor materials selected from a red phosphor material, a green phosphor material and a blue phosphor material, and is formed on or above the address electrode. When the plasma display is for a color display, specifically, a phosphor layer made of a red phosphor material (red phosphor layer) is formed on or above an address electrode, a phosphor layer made of a green phosphor material (green phosphor layer) is formed on another address electrode, and a phosphor layer made of a blue phosphor material (blue phosphor layer) is formed on still another address electrode. These phosphor layers that emit three primary colors constitutes one set, and such sets are formed in a predetermined order. A region where a pair of the sustain electrodes and one set of the phosphor layers that emit three primary colors overlap corresponds to one pixel. The red phosphor layer, the green phosphor layer and the blue phosphor layer may be formed in the form of a stripe or a dot.

As a phosphor material for constituting the phosphor layer, a phosphor material which has high quantum efficiency and causes less saturation to a vacuum ultraviolet ray can be selected from known phosphor materials as required. When the plasma display is assumed to be used as a color display, it is preferred to combine those phosphor materials which have color purities close to three the primary colors defined in NTSC, which have good white balance when three primary colors are mixed, which show a small afterglow time period and which can secure that the afterglow time periods of three primary colors are nearly equal. Examples of phosphor material which emits light in red upon irradiation with a vacuum ultraviolet ray include ($Y_2O_3$: Eu), ($YBO_3Eu$), ($YVO_4$:Eu), ($Y_{0.96}P_{0.60}V_{0.40}O_4$:$Eu_{0.04}$) [(Y,Gd)$BO_3$:Eu], ($GdBO_3$:Eu), ($ScBO_3$:Eu) and (3.5MgO 0.5$MgF_2$.$GeO_2$:Mn). Examples of phosphor materials which emits light in green upon irradiation with vacuum ultraviolet light include ($ZnSiO_2$:Mn), ($BaAl_{12}O_{19}$:Mn), ($BaMg_2Al_{16}O_{27}$:Mn), ($MgGa_2O_4$:Mn), ($YBO_3$:Tb), ($LuBO_3$:Tb) and ($Sr_4Si_3O_8Cl_4$:Eu). Examples of phosphor materials which emits light in blue upon irradiation with vacuum ultraviolet ray include ($Y_2SiO_5$:Ce), ($CaWO_4$:Pb), $CaWO_4$, $YP_{0.85}V_{0.15}O_4$, ($BaMgAl_{14}O_{23}$:Eu), ($Sr_2P_2O_7$:Eu) and ($Sr_2P_2O_7$:Sn). The method for forming the phosphor layer includes a thick film printing method, a method in which phosphor particles are sprayed, a method in which an adhesive substance is pre-applied to a region where the phosphor layer is to be formed and phosphor particles are allowed to adhere, a method in which a photosensitive phosphor paste is provided and a phosphor layer is patterned by exposure and development, and a method in which a phosphor layer is formed on the entire surface and unnecessary portions are removed by a sand blasting method.

The phosphor layer may be formed directly on the address electrode or may be formed on the address electrode and on the side walls of the second separation wall. Alternatively, the phosphor layer may be formed on the dielectric material film formed on the address electrode or may be formed on the dielectric material film formed on the address electrode and on the side walls of the second separation wall. Further, the phosphor layer may be formed only on the side walls of the second separation wall. The phrase of "the phosphor layer is formed on or above the address electrode" includes all of the above-described embodiments. The material for the dielectric material film includes a low-melting glass and $SiO_2$. When the dielectric material film is formed on the second substrate and the address electrodes, there is a case where the second separation wall is formed on the dielectric material film, and this case is also included in the case where the second separation wall is formed on the second substrate.

The material for the first, second or third separation wall can be selected from known insulating materials. For example, a mixture of a widely used low-melting glass with a metal oxide such as alumina can be used. The separation wall can be formed by a screen-printing method, a sand blasting method, a dry film method or a photosensitive method. The above dry film method refers to a method in which a photosensitive film is laminated on a substrate, the photosensitive film on regions where the separation walls are to be formed is removed by exposure and development and a material for the separation wall is filled in opening portions formed by the removal and is calcined or sintered. The photosensitive film is combusted and removed by the calcining or sintering and the material for the separation wall filled in the opening portions remains to constitute the separation walls. The above photosensitive method refers to a method in which a photosensitive material layer for forming the separation wall is formed on a substrate, the material layer is patterned by exposure and development and then the patterned material layer is calcined or sintered. The separation walls may be formed in black to form a so-called black matrix. In this case, a high contrast of the display screen can be attained. The method of forming the black separation walls includes a method in which the separation walls are formed from a color resist material colored in black.

The rare gas to be sealed in the space is required to satisfy the following requirements.

① The rare gas is chemically stable and permits setting a high gas pressure from the viewpoint of attaining a longer lifetime for the plasma display.

② The rare gas has a high radiation intensity of a vacuum ultraviolet ray from the viewpoint of attaining higher brightness for a display screen.

③ The radiated vacuum ultraviolet ray has a long wavelength from the viewpoint of increasing energy conversion efficiency from vacuum ultraviolet ray to visible light.

④ The discharge start voltage is low from the viewpoint of decreasing power consumption.

As a rare gas, He (wavelength of resonance line=58.4 nm), Ne (ditto=74.4 nm), Ar (ditto=107 nm), Kr (ditto=124 nm) and Xe (ditto=147 nm) can be used alone or as a mixed gas. The mixed gas is particularly useful since a decrease in the discharge start voltage based on a Penning effect can be expected. Examples of the above mixed gas include a Ne—Ar mixed gas, a He—Xe mixed gas and a Ne—Xe mixed gas. Of these rare gases, Xe having the longest resonance line wavelength is suitable since it also radiates an intense ultraviolet ray having a wavelength of 172 nm.

In the present invention, the glow discharge takes place between the first sustain electrode formed on the first substrate and the second sustain electrode formed on the upper portion of the side wall on one side of the first separation wall, that is, pairs of the sustain electrodes are three-dimensionally arranged unlike a conventional plasma display having pairs of sustain electrodes that are arranged on one plane, so that the discharge cell can be decreased in size.

BRIEF DESCRIPTION OF THE DRAWINGS

The present invention will be explained with reference to the Examples while referring to the drawings.

DESCRIPTION OF THE PREFERRED EMBODIMENTS

EXAMPLE 1

Figure 1:
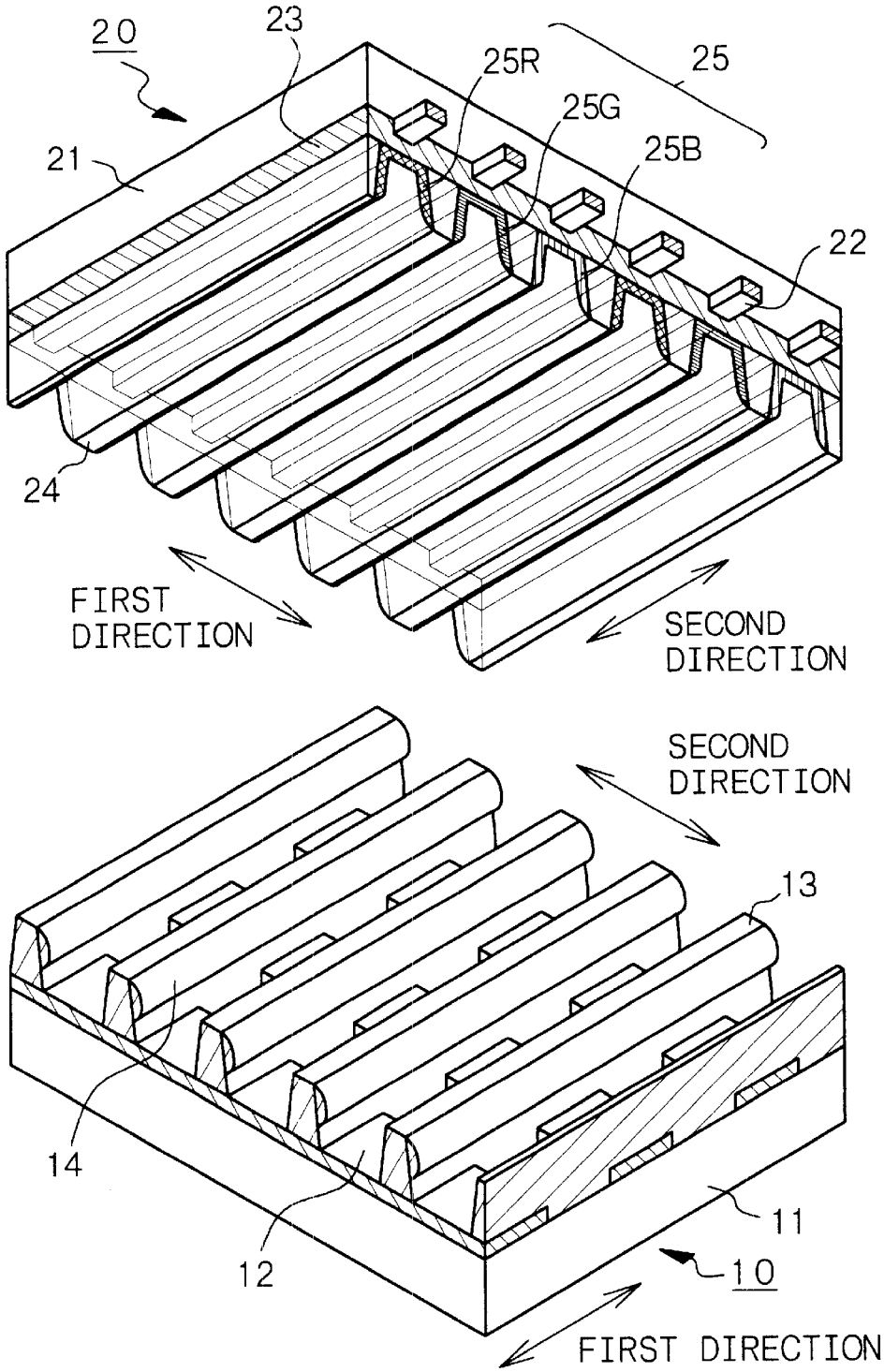
FIG. 1 is a schematic partial exploded perspective view of a plasma display of Example 1.
Figure 2:
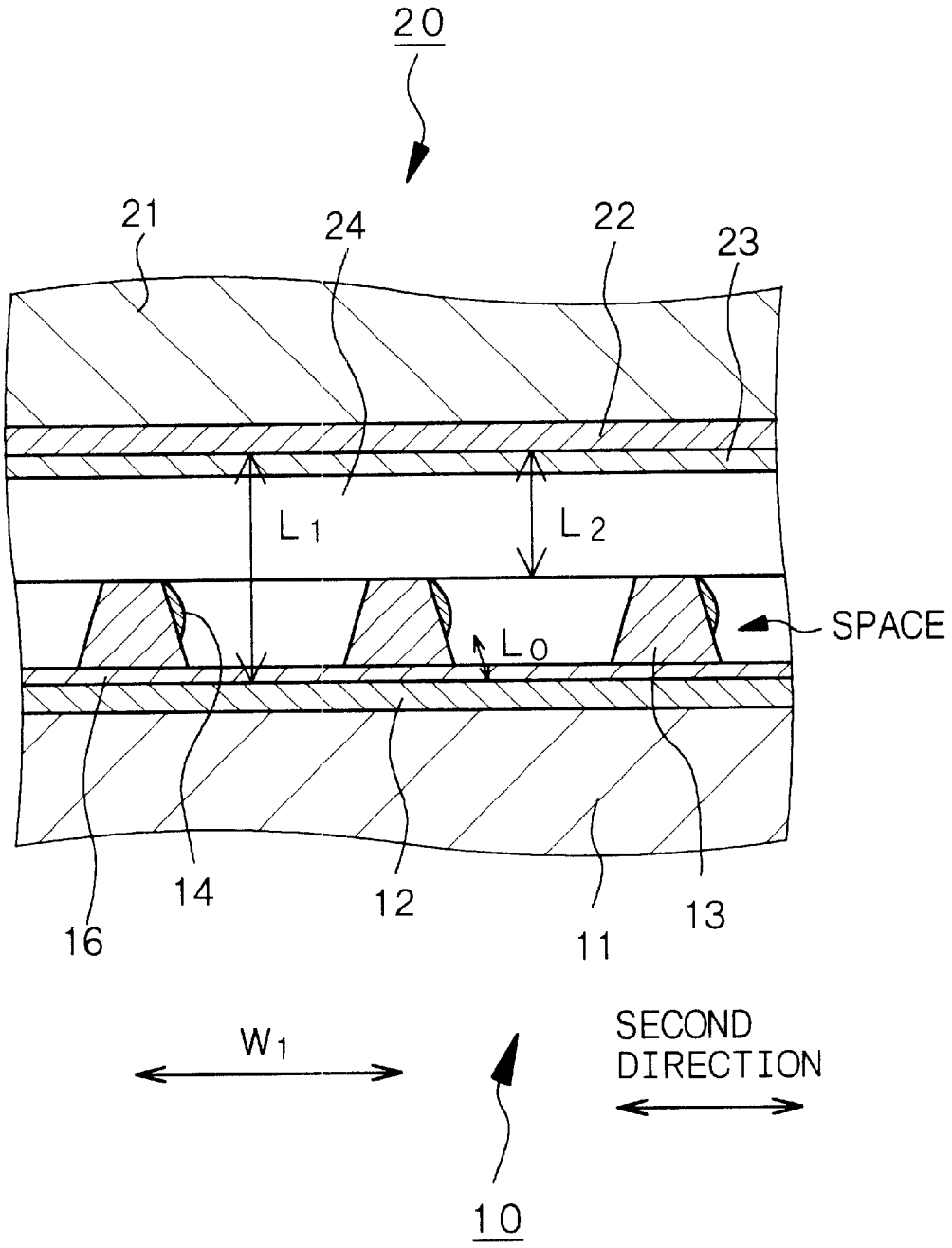
FIG. 2 is a schematic partial cross-sectional view of the plasma display of Example 1.
Figure 3:
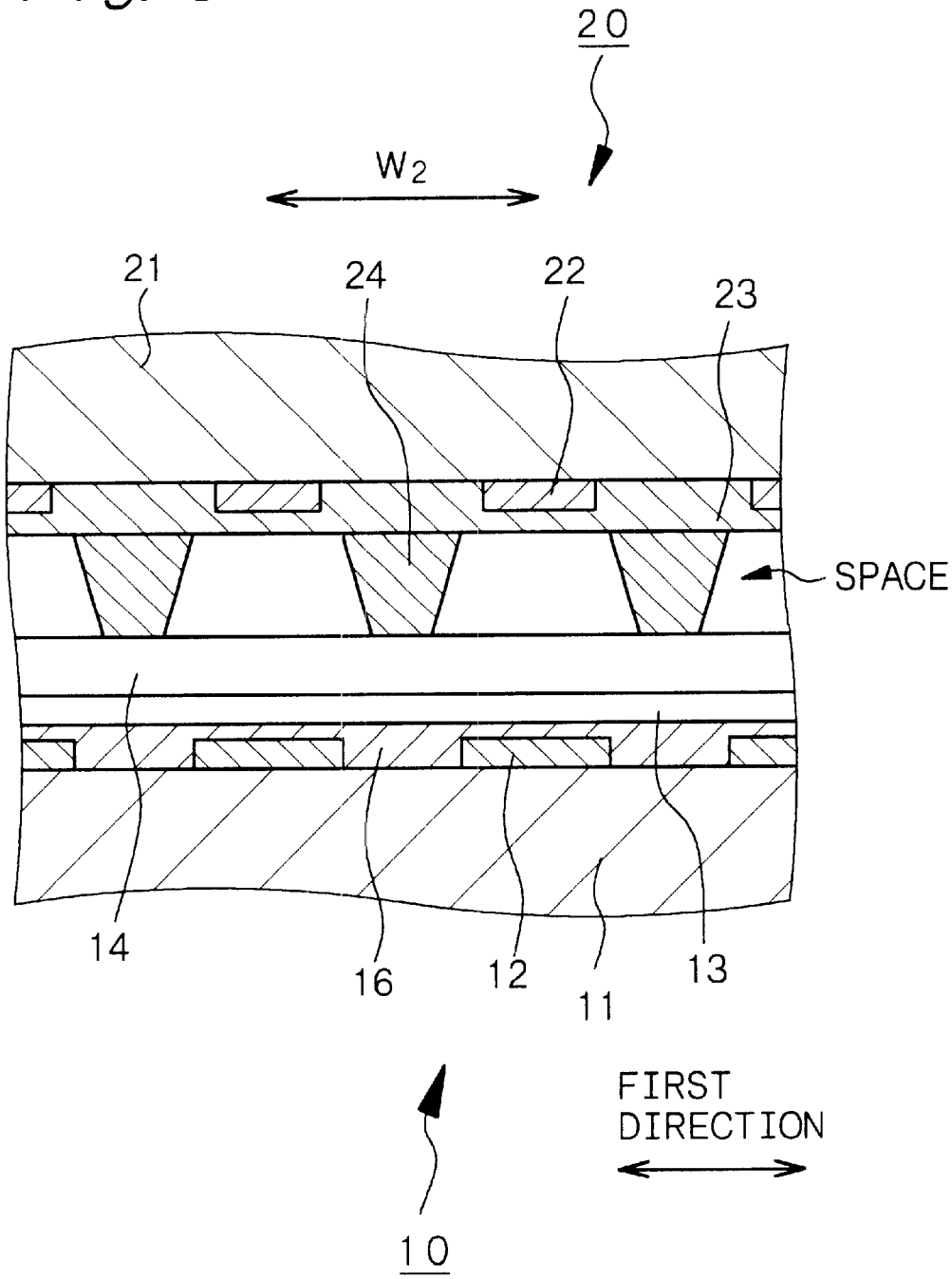
FIG. 3 is a schematic partial cross-sectional view of the plasma display of Example 1, obtained by cutting it with a perpendicular plane different from that for FIG. 2.

Example 1 is concerned with a reflection-type alternating-current-driven-type plasma display having the first constitution of the present invention. The plasma display of Example 1 has a first panel 10 and a second panel 20. Light emission from a phosphor layer is observed through a first substrate. FIG. 1 shows a schematic partial exploded view of the plasma display of Example 1, and FIGS. 2 and 3 show schematic partial cross-sectional views thereof. FIG. 2 is a drawing obtained by cutting the plasma display along a second direction with a perpendicular plane including a first sustain electrode. FIG. 3 is a drawing obtained by cutting the plasma display with a perpendicular plane in parallel with the extending direction of the first separation wall in a region between one first separation wall and another first separation wall.

The first panel 10 comprises a first substrate 11 made, for example, of a soda glass, a first sustain electrode 12 made of ITO and formed on the first substrate 11, a first separation wall 13 formed on the first substrate 11, and a second sustain electrode 14 made of aluminum and formed on an upper portion of a side wall on one side of the first separation wall 13 and spaced from the first sustain electrode 12. The separation wall 13 and the second sustain electrode 14 extend in the first direction. For decreasing the impedance of the first sustain electrode 12, a bus electrode made of a chromium/copper/chromium stacked film is formed along an edge portion of the first sustain electrode 12, while showing of the bus electrode is omitted. Further, the first substrate 11 and the first sustain electrode 12 are covered with a protective layer 16 that is made of magnesium oxide (MgO) and has a thickness of 10 $\mu$m to 30 $\mu$m, while showing of the protective layer 16 is omitted in FIG. 1. In schematic partial exploded views of plasma displays to be explained later, the showing of a bus electrode and a protective layer will be similarly omitted. The first separation wall 13 is formed, more specifically, on the protective layer 16.

The second panel 20 comprises a second substrate 21 made, for example, of a soda glass, a second separation wall 24 extending in a second direction different from the first direction in which the first separation wall 13 extends, an address electrode 22 made of silver and formed on the second substrate 21, and a phosphor layer 25 (25R, 25G and 25B). A 10 $\mu$m to 30 $\mu$m thick dielectric material film 23 made of a low-melting glass is formed on the second substrate 21 and the address electrode 22. The second separation wall 24 is formed on the second substrate 21. More specifically, the second separation wall 24 is formed on the dielectric material film 23. Further, the phosphor layer 25 is formed above the address electrode 22. More specifically, the phosphor layer 25 is formed on the dielectric material film 23 formed on the address electrode 22 and is also formed on side walls of the second separation wall 24. Each phosphor layer 25 is composed of a red phosphor layer 25R, a green phosphor layer 25G and a blue phosphor layer 25B. These phosphor layers 25R, 25G and 25B, which emit three primary colors constitute one set, and such sets are provided in a predetermined order. In FIGS. 2, 3, 7, 8, 11 and 12, showing of the phosphor layers 25 is omitted.

In Example 1, the address electrode 22 extends in the second direction. The first sustain electrode 12 also extends in the second direction. The first separation wall 13 is formed across the first sustain electrode 12. In the plasma display of Example 1, as shown in FIG. 2, the distance ($L_1$) between the first sustain electrode 12 and the address electrode 22 was 150 $\mu$m, and the distance ($L_2$) between the second sustain electrode 14 and the address electrode 22 is 30 $\mu$m. Further, the distance ($L_0$) between the first sustain electrode 12 and the second sustain electrode 14 is 10 $\mu$m.

Further, the distance ($W_1$) between the neighboring first separation walls 13 is 300 $\mu$m, and as shown in FIG. 3, the distance ($W_2$) between the neighboring second separation walls 24 is 100 $\mu$m.

The first panel 10 and the second panel 20 are arranged to face each other in a state where the protective layer (not shown) and the second separation walls are in contact with each other, and these panels are bonded to each other in their circumferential portions through a seal layer (not shown). The space formed by the first panel 10 and the second panel 20 is charged, for example, with a Ne—Xe mixed gas (for example, a 50% Ne—50% Xe mixed gas) at a pressure of $2\times10^4$ Pa and sealed.

In a pixel where AC-glow discharge is maintained, the phosphor layer 25 is excited on irradiation with a vacuum ultraviolet ray radiated on the basis of a rare gas excitation caused in the space, and the phosphor layer 25 emits light in a color inherent to the phosphor material.

The method for producing the plasma display of Example 1 will be generally explained below. In the following explanation, the first substrate 11 or all of elements formed thereon at any stage during the production process or the second substrate 21 or all of elements formed thereon at any stage during the production process will be sometimes referred to as "substratum". FIGS. 4A to 4D given for explaining the method for producing the first panel 10 are schematic partial cross-sectional views obtained by cutting the first substrate 11, etc., with a perpendicular plane including the first sustain electrode, etc., along the second direction.

The first panel 10 can be produced by the following method. First, an ITO layer is formed on the entire surface of the first substrate 11, for example, by a sputtering method and then patterned in the form of. a stripe by photolithography and an etching method, whereby the first sustain electrode 12 is formed (see FIG. 4A). The first sustain electrode 12 extends in the second direction. Then, a chromium/copper/chromium stacked film is formed on the entire surface of the substratum (specifically, on the first substrate 11 and the first sustain electrode 12), for example, by a sputtering method and then patterned by photolithography and an etching method, whereby the bus electrode (not shown) is formed along the edge portion of the first sustain electrode 12.

[Step-110]

Then, a protective layer 16 is formed on the entire surface of the substratum (specifically, on the first substrate 11, the first sustain electrode 12 and the bus electrode). The protective layer 16 can be an approximately 0.7 $\mu$m thick single layer made of magnesium oxide (MgO). The protective layer 16 can be obtained by forming a magnesium oxide layer on the entire surface by an electron-beam-deposition method.

[Step-120]

Figure 4A:
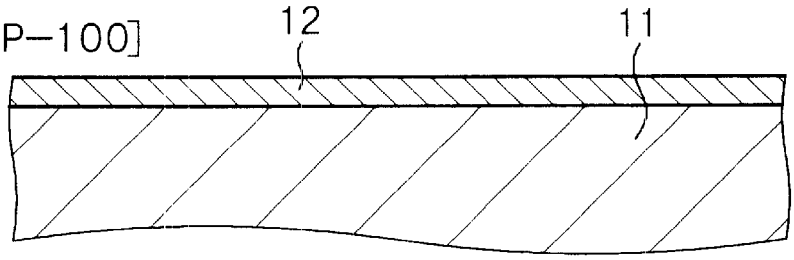
FIGS. 4A, 4B, 4C and 4D are schematic partial cross-sectional views of a first substrate, etc., for explaining the method for producing a first panel in the plasma display of Example 1.
Figure 4B:
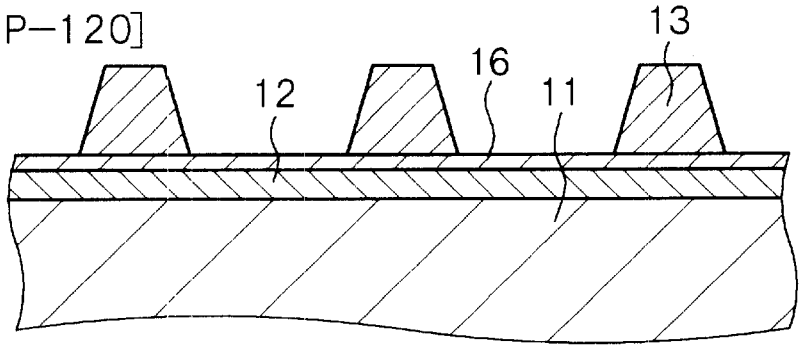

Then, a low-melting glass paste is screen-printed on the protective layer 16 in the form of a stripe and then calcined or sintered, whereby the first separation wall 13 is formed (see FIG. 4B). The first separation wall 13 extends in the first direction.

[Step-130]

Figure 4C:
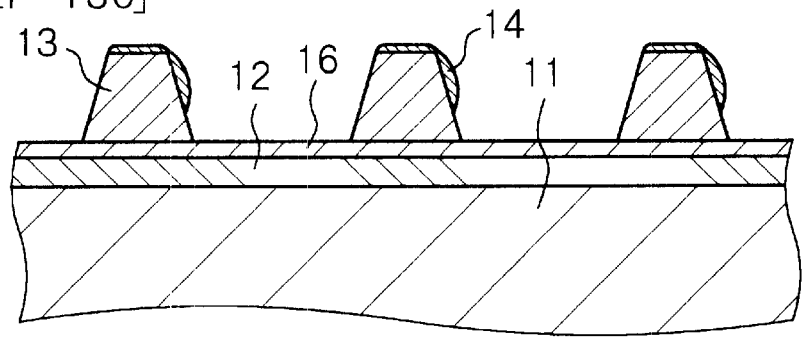
Figure 4D:
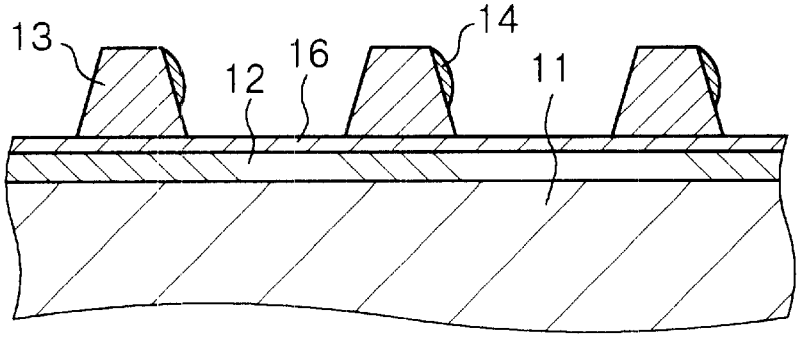

Then, aluminum is sputtered by an oblique sputtering method to form the second sustain electrode 14 on an upper portion of a side wall on one side of the first separation wall 13 (see FIG. 4C). The second sustain electrode 14 is formed such that it is spaced from the first sustain electrode 12. While an aluminum layer also is formed on the top surface of the first separation wall 13, it is desirable to remove the aluminum layer formed on the above top surface of the first separation wall 13 by polishing or etching. In the above manner, the structure shown in FIG. 4D is obtained. The first panel 10 can be completed by the above steps.

The second panel 20 can be produced by the following method. First, a silver paste is printed on the second substrate 21 in the form of a stripe, for example, by a screen-printing method and calcined or sintered, whereby the address electrode 22 is formed. The address electrode 22 extends in the second direction. Then, a low-melting glass paste layer is formed on the entire surface of the substratum (specifically, on the second substrate 21 and the address electrode 22) by a screen-printing method and calcined or sintered, whereby the dielectric material film 23 is formed. Then, a low-melting glass paste is printed on the dielectric material film 23 above a region between the neighboring address electrodes 22, for example, by a screen-printing method and calcined or sintered, whereby the second separation wall 24 is formed. The phosphor slurries for three primary colors are consecutively printed and calcined or sintered, whereby the phosphor layers 25R, 25G and 25B are formed. The second panel 20 can be completed by the above steps.

Then, the plasma display is assembled. First, a seal layer (not shown) is formed in a circumferential portion of the second panel 20, for example, by a screen-printing method. Then, the first panel 10 and the second panel 20 are bonded to each other and calcined or sintered to cure the seal layer. Then, a space formed between the first panel 10 and the second panel 20 is vacuumed, and then the space is charged with a Ne—Xe mixed gas (for example, a 50% Ne—50% Xe mixed gas) at a pressure of $2\times10^4$ Pa and sealed to complete the plasma display. When the first panel 10 and the second panel 20 are bonded to each other in a chamber charged with a Ne—Xe mixed gas at a pressure of $2\times10^4$ Pa, the steps of vacuuming the space and charging the space with the Ne—Xe mixed gas can be omitted.

EXAMPLE 2

Figure 5:
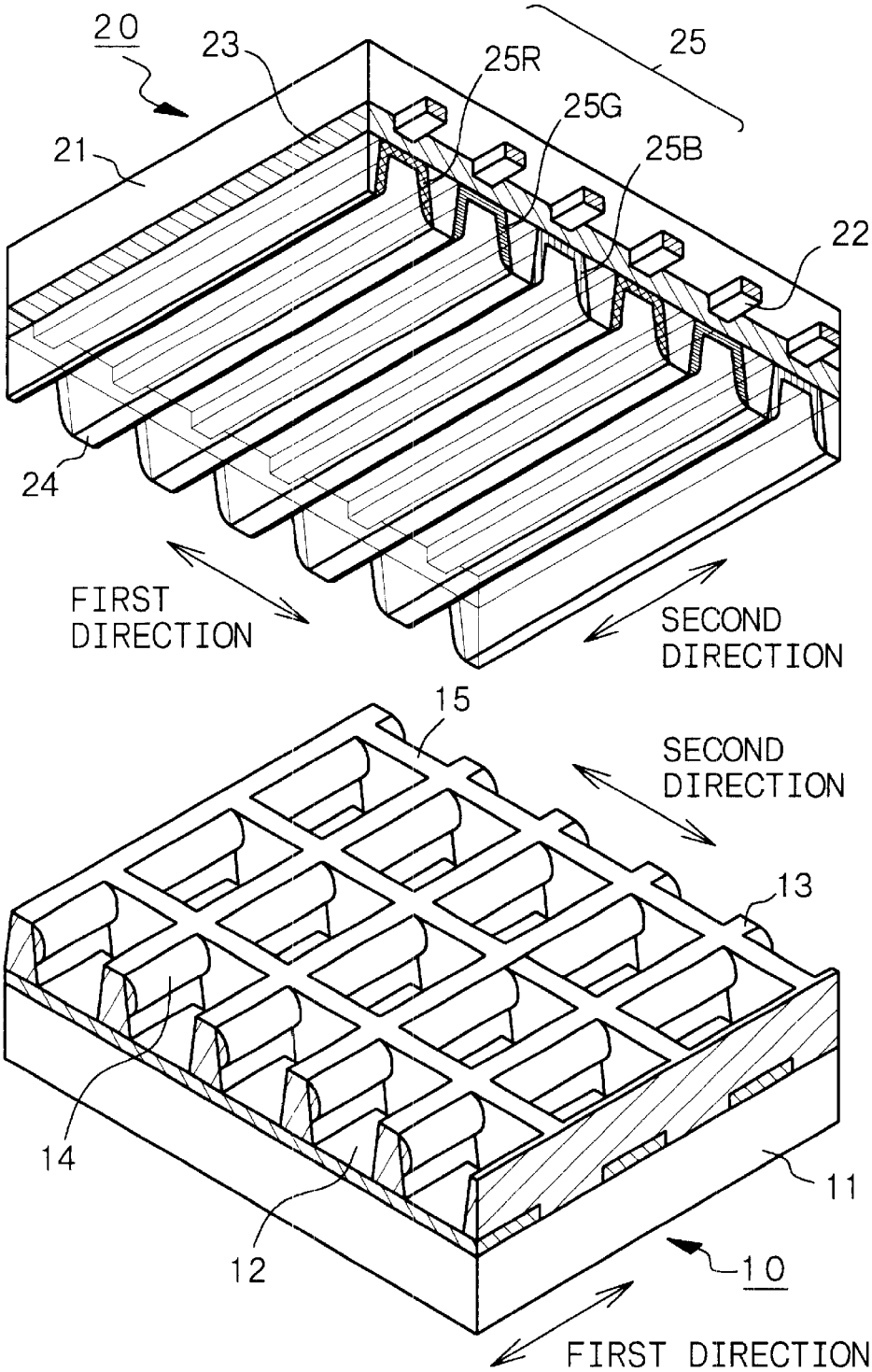
FIG. 5 is a schematic partial exploded perspective view of a plasma display of Example 2.

FIG. 5 shows a schematic partial exploded view of a plasma display of Example 2. The plasma display of Example 2 is a variant of the plasma display of Example 1, and the first panel 10 further has a third separation wall 15 that is formed on the first substrate 11 and extends in the second direction. The third separation wall 15 is formed across the second sustain electrode 14 and further formed on the first substrate 11 exposed between one first sustain electrode 12 and another sustain electrode 12. That is, the first and third separation walls 13 and 15 are formed on the first substrate 11 in the form of a lattice. The second sustain electrode 14 is present under the third separation wall 15. The third separation wall 15 can reliably prevent the occurrence of an optical crosstalk between neighboring discharge cells. The separation wall 15 extends in the second direction.

The first panel 10 in the Example 2 can be produced by the following production method. That is, [Step-100] to [Step-130] in Example 1 are carried out, to obtain the structure shown in FIG. 4D. Then, the gaps between the first separation walls 13 are filled, for example, by screen-printing a low-melting glass paste on the entire surface. Then, unnecessary portions of the low-melting glass paste are removed by a sand-blasting method. The unnecessary portions of the low-melting glass paste can be easily removed by a sand-blasting method since it is not calcined yet. When a mask layer is formed beforehand on low-melting glass paste portions where the third separation walls are to be formed and on the first separation walls 13, the low-melting glass paste portions where the third separation walls are to be formed and the first separation walls 13 can be reliably protected when the unnecessary portions of the low-melting glass paste are removed by a sand-blasting method. Then, the remaining low-melting glass paste portions are calcined or sintered, whereby the third separation walls 15 can be formed.

EXAMPLE 3

Figure 6:
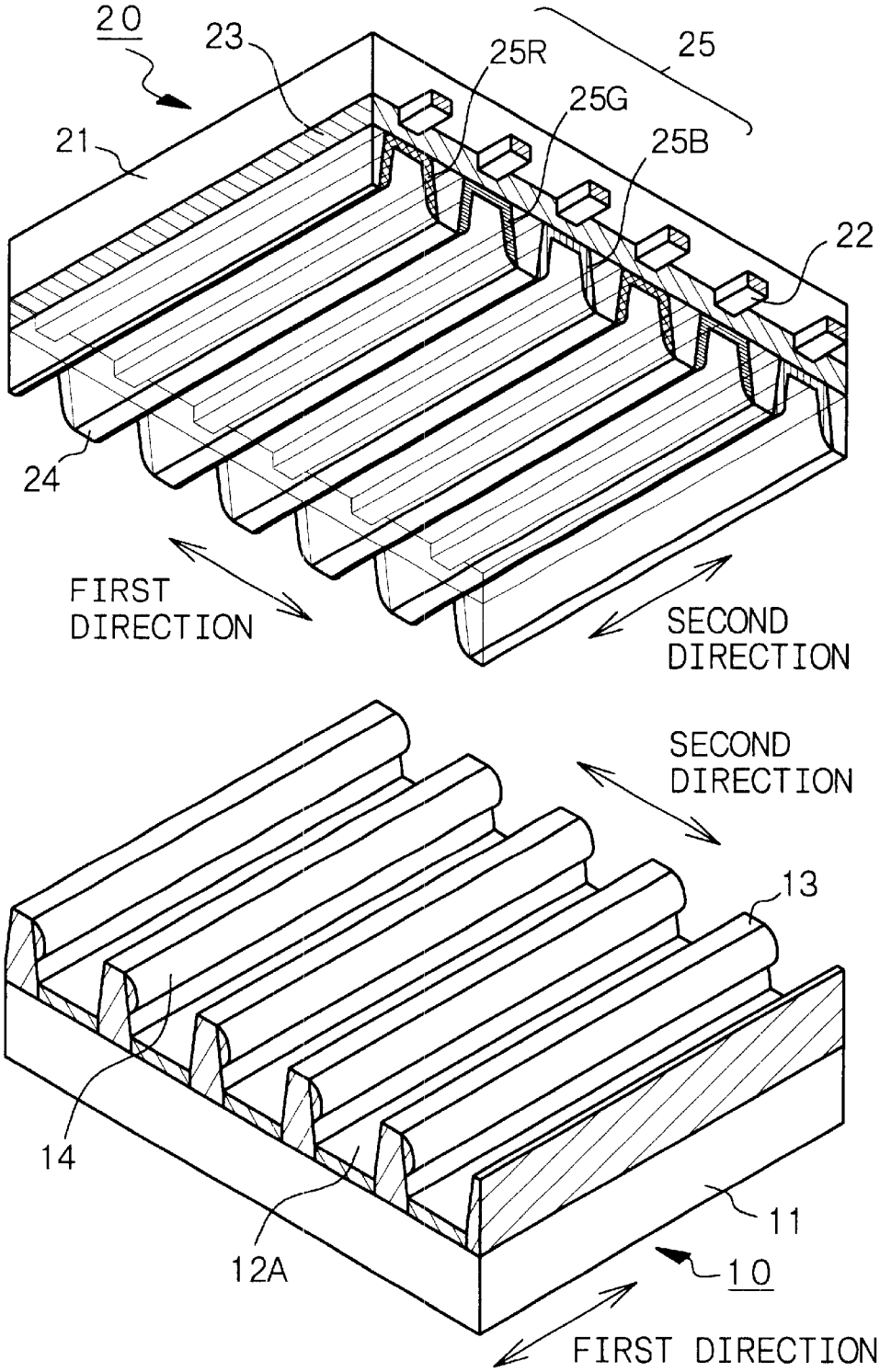
FIG. 6 is a schematic partial exploded perspective view of a plasma display of Example 3.
Figure 7:
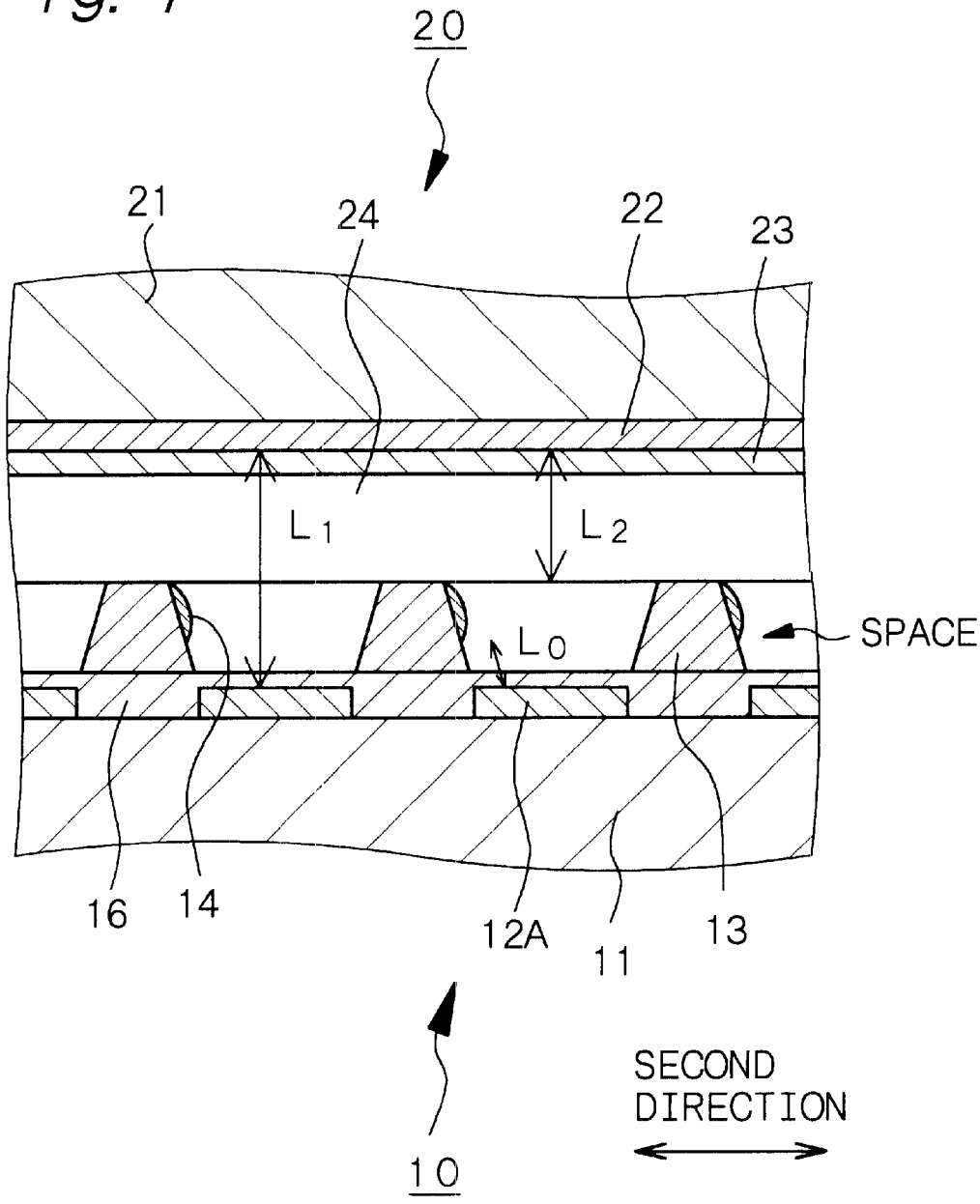
FIG. 7 is a schematic partial cross-sectional view of the plasma display of Example 3.
Figure 8:
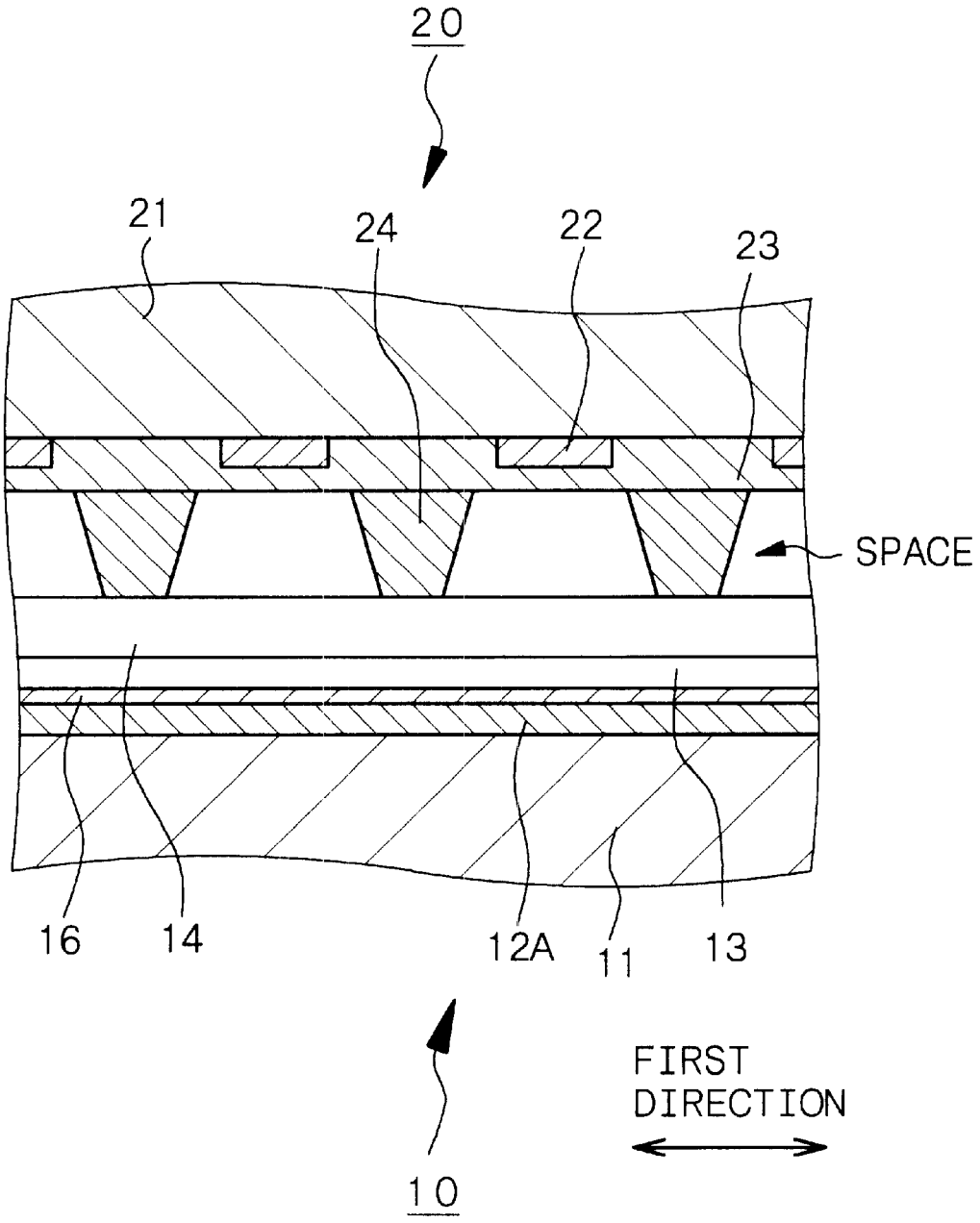
FIG. 8 is a schematic partial cross-sectional view of the plasma display of Example 3, obtained by cutting it with a perpendicular plane different from that for FIG. 7.

Example 3 is concerned with an alternating-current-driven type plasma display having the second constitution of the present invention. FIG. 6 shows a schematic partial exploded view of the plasma display of Example 3, and FIGS. 7 and 8 show schematic partial cross-sectional views thereof. FIG. 7 is a drawing obtained by cutting the plasma display along the second direction with a perpendicular plane including an address electrode 22. FIG. 8 is a drawing obtained by cutting the plasma display along the first direction with a perpendicular plane including a first sustain electrode 12A.

The plasma display of Example 3 differs from the plasma display of Example 1 in that the first sustain electrode 12A does not extend in the second direction but extends in the first direction. Except for the above point, the plasma display of Example 3 is structurally the same as the plasma display of Example 1, so that a detailed explanation thereof is omitted. Further, the first panel 10 in Example 3 can be produced by the substantially same method as that explained in Example 1, so that a detailed explanation of its production method is also omitted.

EXAMPLE 4

Figure 9:
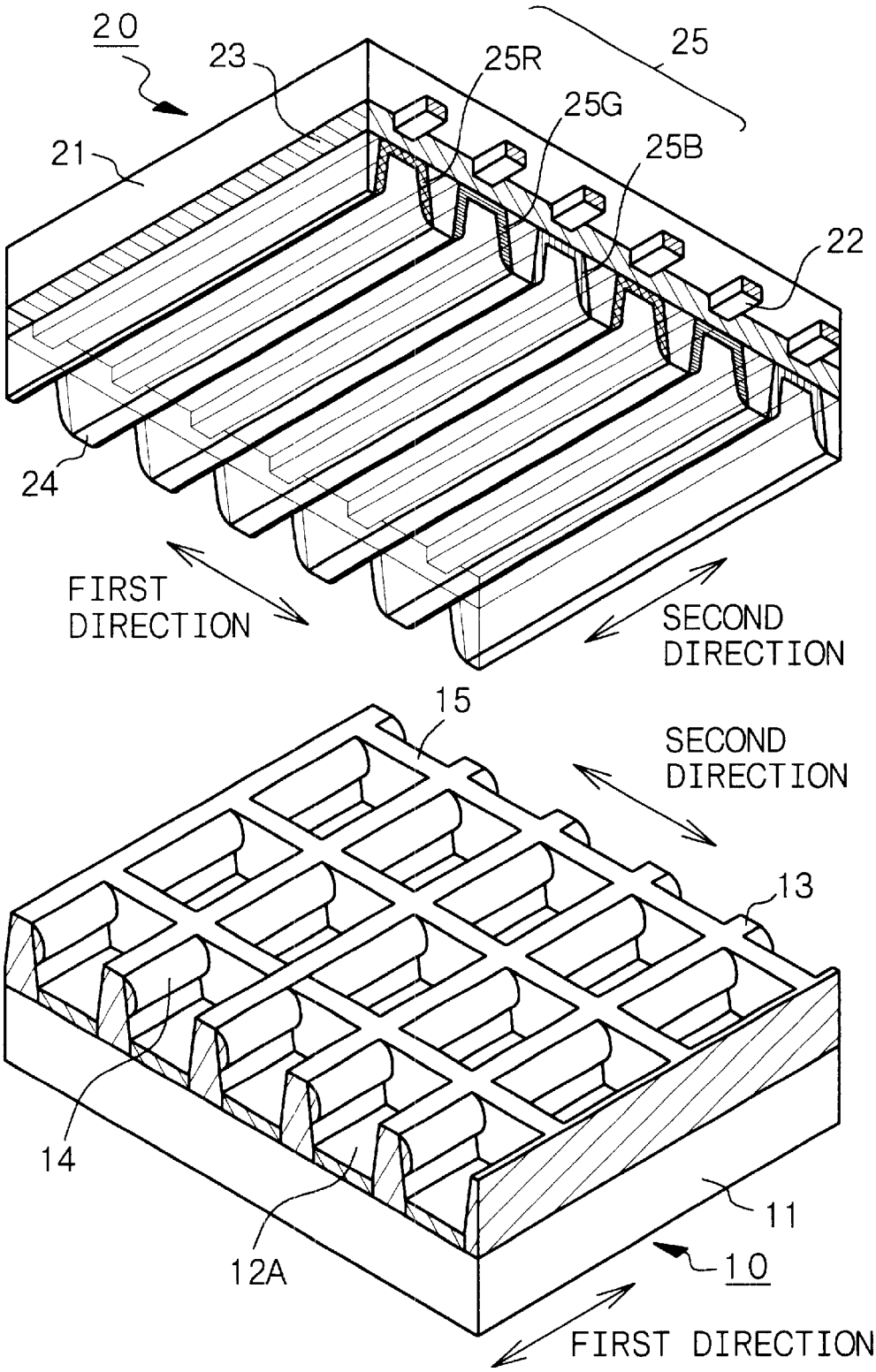
FIG. 9 is a schematic partial exploded perspective view of a plasma display of Example 4.

FIG. 9 shows a schematic partial exploded view of a plasma display of Example 4. The plasma display of Example 4 is a variant of the plasma display of Example 3, and the first panel 10 further has a third separation wall 15 that is formed on the first substrate 11 and extends in the second direction. The third separation wall 15 is formed across the first sustain electrode 12A and the second sustain electrode 14. That is, the first and third separation walls 13 and 15 are formed on the first substrate 11 in the form of a lattice. The first sustain electrode 12A and the second sustain electrode 14 are present under the third separation wall 15. The third separation wall 15 can reliably prevent optical crosstalk between neighboring discharge cells. The second separation wall 15 extends in the second direction.

The first panel 10 of Example 4 can be produced by substantially the same production method as that explained in Example 2, so that a detailed explanation of the method for producing the same is omitted.

EXAMPLE 5

Figure 10:
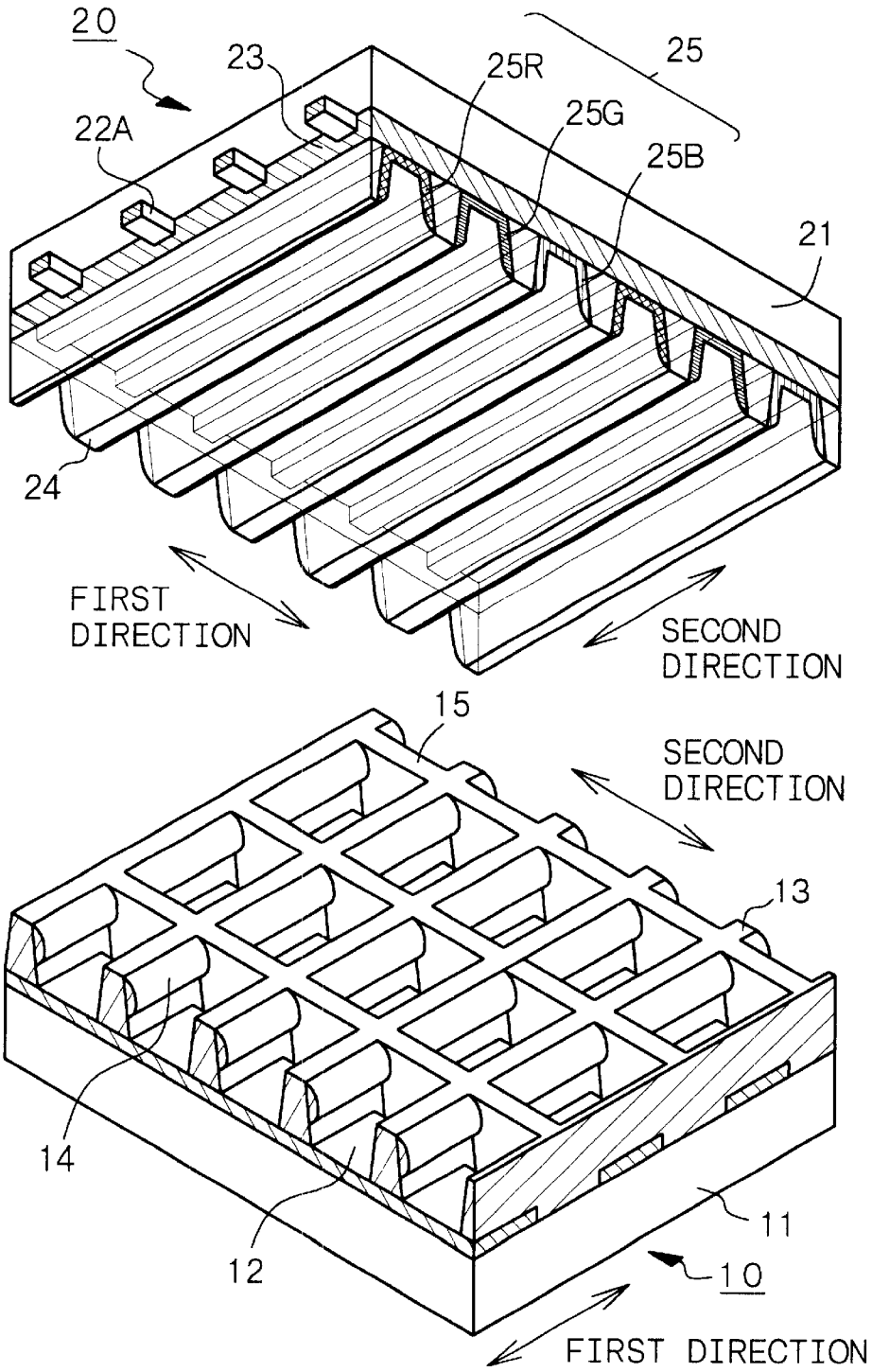
FIG. 10 is a schematic partial exploded perspective view of a plasma display of Example 5.
Figure 11:
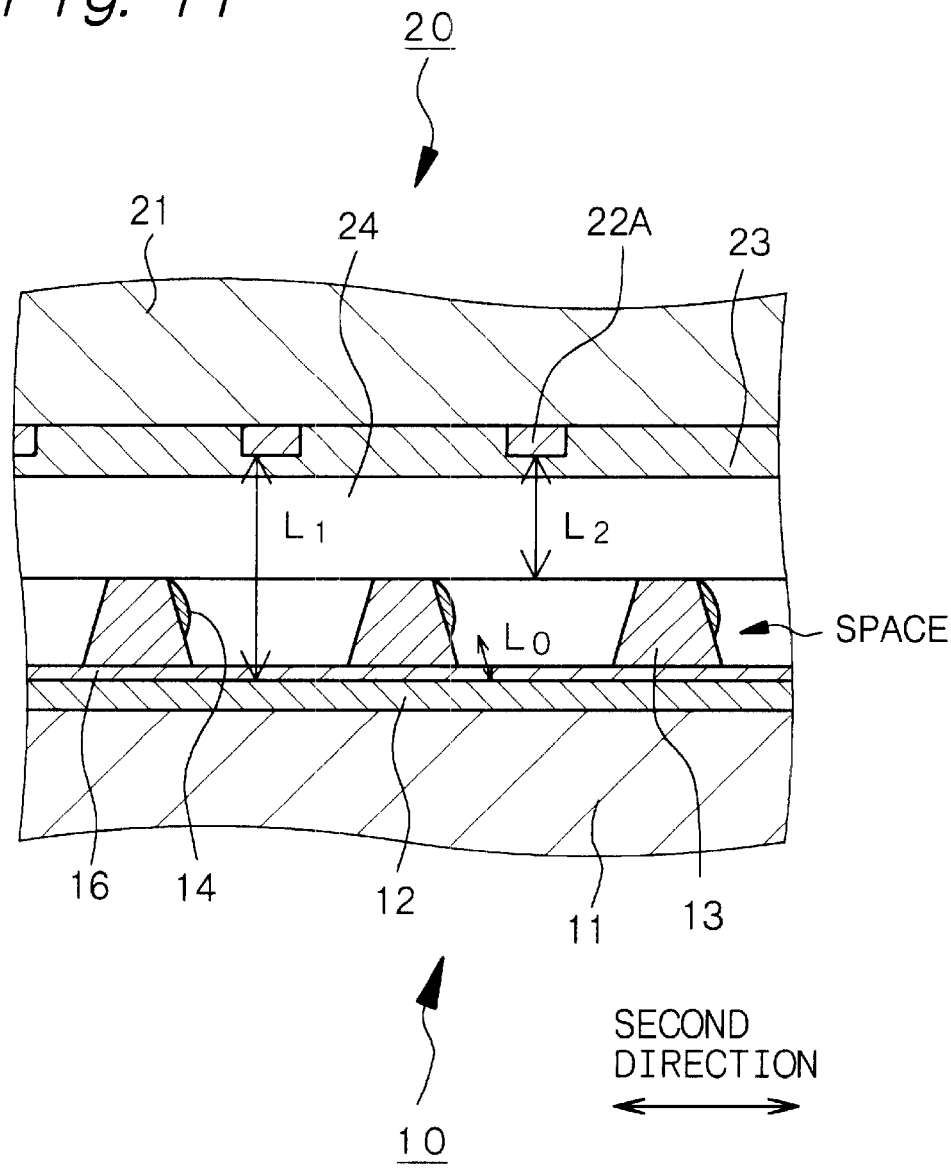
FIG. 11 is a schematic partial cross-sectional view of the plasma display of Example 5.
Figure 12:
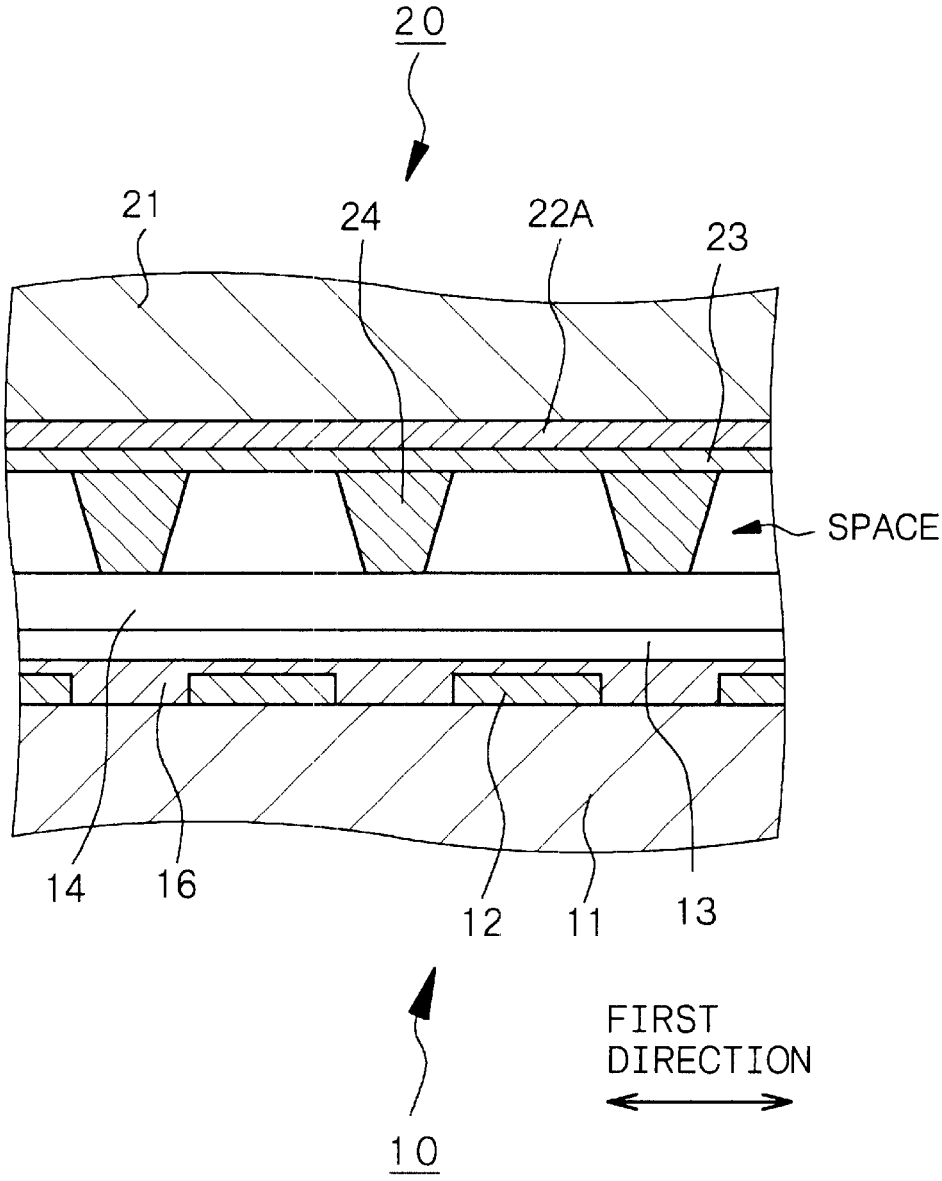
FIG. 12 is a schematic partial cross-sectional view of the plasma display of Example 5, obtained by cutting it with a perpendicular plane different from that for FIG. 11.
Figure 13A:
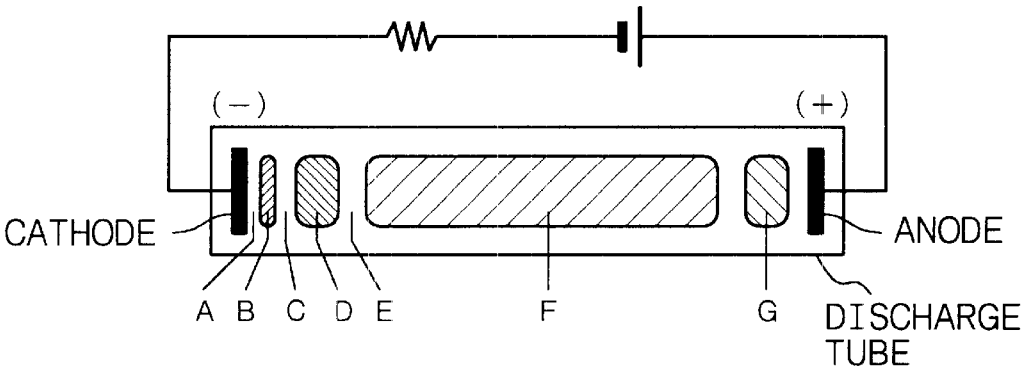
FIGS. 13A and 13B are schematic drawings showing glow discharge states.
Figure 13B:
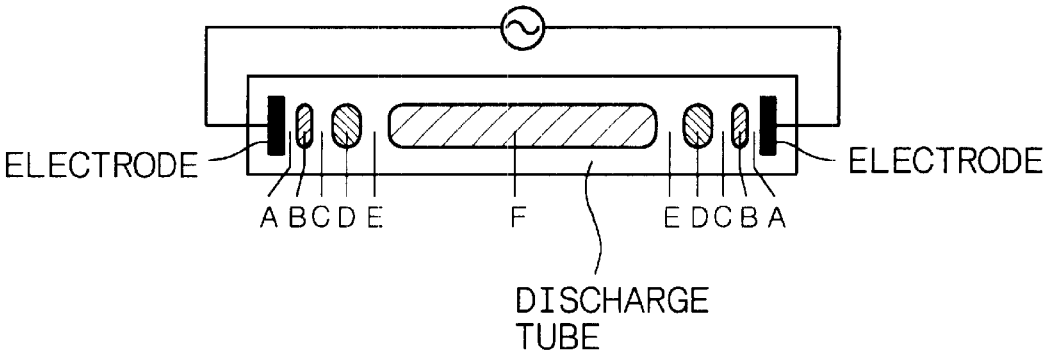
Figure 14A:
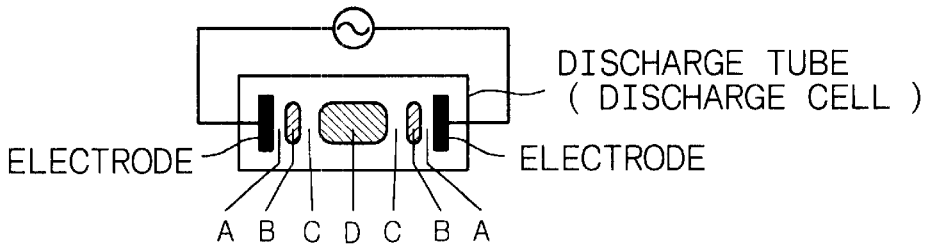
FIGS. 14A and 14B are schematic drawings showing states of glow discharge between a first sustain electrode and a second sustain electrode.
Figure 14B:
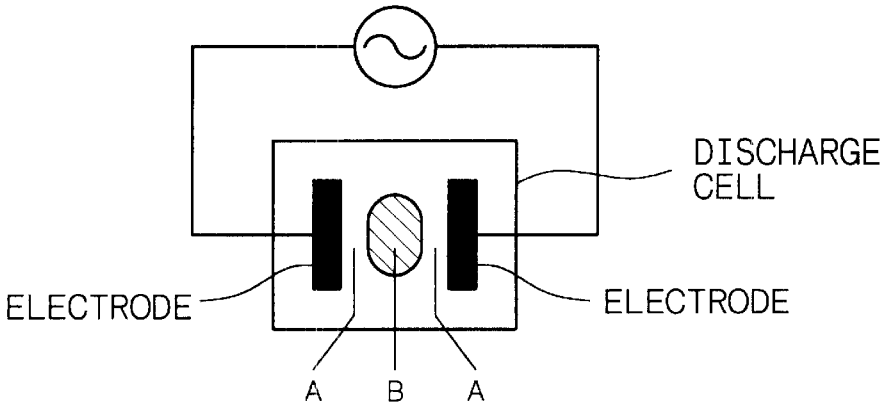
Figure 15:
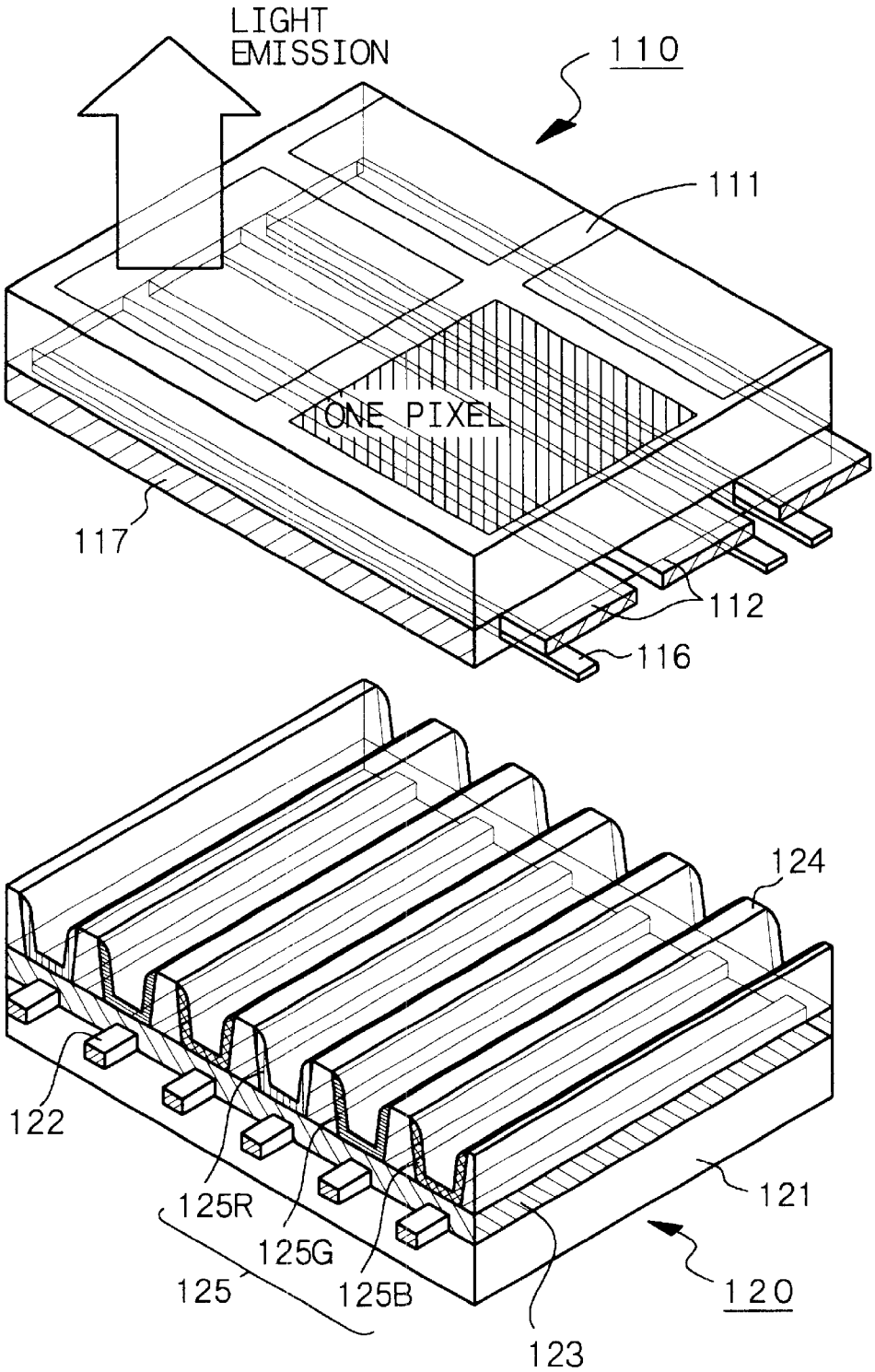
Fig. 15 (PRIOR ART)
FIG. 15 is a partial exploded perspective view showing a typical constitution of a conventional three-electrode-type alternating-current-driven-type plasma display.

Example 5 is concerned with an alternating current driven type plasma display having the third constitution of the present invention. FIG. 10 shows a schematic exploded perspective view of the plasma display of Example 5, and FIGS. 11 and 12 show schematic partial cross-sectional views thereof. FIG. 11 is a drawing obtained by cutting the plasma display along the second direction with a perpendicular plane including a first sustain electrode 12. FIG. 12 is a drawing obtained by cutting the plasma display along the first direction with a perpendicular plane including an address electrode 22A.

The plasma display of Example 5 differs from the plasma display of Example 1 in that the first panel 10 has a third separation wall 15 that is formed on the first substrate 11 and extends in the second direction and an address electrode 22A extends in the first direction. The first sustain electrode 12 extends in the second direction. The first and third separation walls 13 and 15 are formed on the first substrate 11 in the form of a lattice. The third separation wall 15 is formed across the second sustain electrode 14, and is formed on a portion of the first substrate 11 exposed between the first sustain electrodes 12. The second separation wall 24 is formed across the address electrode 22. The third separation wall 15 can reliably prevent an optical crosstalk between neighboring discharge cells. The plasma display of Example 5 is structurally the same as the plasma display of Example 1 except for the above points, so that a detailed explanation thereof is omitted. The first panel 10 of Example 5 can be produced by substantially the same production method as that explained in Example 2, so that a detailed explanation of the method for producing the same is omitted.

The present invention has been explained with reference to the examples hereinabove, while the present invention shall not be limited thereto. The constitutions, structures and production methods of the first panel 10 and the second panel 20 and the materials used for the production thereof in any example are give as examples and can be modified or altered as required. The plasma display of any example can be a transmission type plasma display in which light emission from the phosphor layer is observed through the second substrate. For forming the first sustain electrode 12 and the first separation wall 13 in the first substrate 11, there may be employed a method in which a first substrate made of a glass having convexo-concave shapes (convex portions correspond to the first separation walls) formed is provided, or convexo-concave shapes (convex portions correspond to the first separation walls) are formed in the first substrate made of a glass by a dicing method or a sand blasting method, and the first sustain electrode is formed between the first separation walls, for example, by a lift-off method.

In the present invention, since a pair of the sustain electrodes for causing the glow discharge is three-dimensionally arranged, the discharge distance in the glow discharge can be attained in nearly the perpendicular direction. Each discharge cell can be therefore decreased in size, and as a result, the discharge cell pitch can be decreased. That is, there can be obtained a plasma display having 0.1 mm dots or smaller, and a high-fineness display can be provided. Further, there can be provided a large plasma display structurally.

What is claimed is:

1. An alternating current driven type plasma display having a first panel and a second panel, said first panel comprising;

(A) a first substrate, (B) a first sustain electrode formed on the first substrate, (C) a first separation wall which is formed on the first substrate and extends in a first direction, and (D) a second sustain electrode formed on an upper portion of a side wall on one side of the first separation wall and spaced from the first sustain electrode, and said second panel comprising;

(a) a second substrate, (b) a second separation wall which is formed on the second substrate and extends in a second direction different from the first direction in which the first separation wall extends, (c) an address electrode formed on the second substrate, and (d) a phosphor layer formed on or above the address electrode.

2. The alternating current driven type plasma display according to claim 1, wherein the address electrode extends in the second direction.

3. The alternating current driven type plasma display according to claim 2, wherein the first sustain electrode extends in the second direction.

4. The alternating current driven type plasma display according to claim 2, wherein the first sustain electrode extends in the first direction.

5. The alternating current driven type plasma display according to claim 3 or 4, wherein the first panel further has a third separation wall which is formed on the first substrate and extends in the second direction.

6. The alternating current driven type plasma display according to claim 1, wherein the first panel further has a third separation wall which is formed on the first substrate and extends in the second direction, the first sustain electrode extends in the second direction, and the address electrode extends in the first direction.

7. The alternating current driven type plasma display according to claim 1, wherein the distance between the first sustain electrode and the address electrode is $1\times10^{-5}$ m to $4\times10^{-4}$ m, and the distance between the second sustain electrode and the address electrode is $5\times10^{6}$ m to $3\times10^{-4}$ m.

* * * * *

UNITED STATES PATENT AND TRADEMARK OFFICE

CERTIFICATE OF CORRECTION

PATENT NO. : 6,469,451 B2
DATED : October 22, 2002
INVENTOR(S) : Hiroshi Mori

It is certified that error appears in the above-identified patent and that said Letters Patent is hereby corrected as shown below:

Column 14,
Lines 52 and 60, replace "which" with -- that --.

Column 15,
Line 12, replace "which" with -- that --.

Column 16,
Line 3, replace "which" with -- that --.
Line 11, "$10^6$" should read -- $10^{-6}$ --.

Signed and Sealed this

Fifth Day of August, 2003

JAMES E. ROGAN
*Director of the United States Patent and Trademark Office*